United States Patent [19]

Schron

[11] Patent Number: 4,627,711

[45] Date of Patent: Dec. 9, 1986

[54] MACHINE SHUTDOWN CONTROL

[75] Inventor: Steven M. Schron, Rochester, N.Y.

[73] Assignee: Xerox Corporation, Stamford, Conn.

[21] Appl. No.: 781,569

[22] Filed: Sep. 30, 1985

[51] Int. Cl.[4] ..... G03G 15/00

[52] U.S. Cl. ..... 355/14 SH; 355/3 R; 355/3 SH; 355/14 C

[58] Field of Search ..... 355/3 R, 3 SH, 14 R, 355/14 SH, 14 C

[56] References Cited

U.S. PATENT DOCUMENTS

| | | | |
|---|---|---|---|
| 3,588,472 | 6/1971 | Glaster et al. | 355/14 |
| 3,851,966 | 12/1974 | Reehil et al. | 355/17 |
| 3,944,794 | 3/1976 | Reehil et al. | 235/92 |
| 4,062,061 | 12/1977 | Batchelor et al. | 364/900 |
| 4,166,133 | 8/1979 | Diamond | 424/346 |
| 4,338,023 | 7/1982 | McGibbon | 355/14 |
| 4,372,673 | 2/1983 | Tomosada et al. | 355/14 R |
| 4,392,740 | 7/1983 | Ito et al. | 355/14 SH |
| 4,394,085 | 7/1983 | Dennhardt | 355/3 R |
| 4,395,111 | 7/1983 | Takahashi et al. | 355/14 R |
| 4,472,049 | 9/1984 | Honma et al. | 355/14 SH |
| 4,474,454 | 10/1984 | Sugiura | 355/14 R |
| 4,549,805 | 10/1985 | Iimori | 355/3 SH |
| 4,557,587 | 12/1985 | Komiya et al. | 355/14 C |

*Primary Examiner*—A. C. Prescott

*Attorney, Agent, or Firm*—R. F. Chapuran

[57] ABSTRACT

The present invention is the controlled shutdown of the preregistration, fuser, dedicated duplex tray, and machine exit zones of the copy sheet handling system of a machine. In particular, a control data base includes a packet phase describing the origin and destination and all specific details of how each individual copy sheet is to move through the system, a tracker phase showing the current physical location of the sheet in the system, wherein both the lead edge and trail edge of each sheet is tracked and dynamically updated at each control point, and a fault phase showing the specific element that has the fault and which edge of the sheet is the fault, and also showing that a fault has been responded to by the system. At the detection of a malfunction or jam, the control evaluates the status of the sheets in the sheet handling system and makes determinations, for example, to hold sheets from entering into the boundary between the preregistraton, fuser, duplex tray, and machine exit zones, or drives a sheet at the boundary into the next zone.

13 Claims, 3 Drawing Figures

MACHINE SHUTDOWN CONTROL

This invention relates to a xerographic printer control, and in particular, to the control of a shutdown of the machine due to a copy sheet path malfunction.

In prior art xerographic printing machines, machine malfunctions causing machine downtime and service repair cost have always been a concern. With this in mind, often times machines have been designed to make the paper path as readily accessible as possible to the operator and service representative. Also, various diagnostic and jam recovery techniques have been used and are well known in the prior art. For example, U.S. Pat. No. 3,588,472 discloses a counter system to track the copy sheets entering and leaving a transport path station. U.S. Pat. No. 3,851,966 discloses a method for minimizing problems in a xerographic printing machine caused by misfeed of copy paper the misfeed is minimized by discharging the image on the photoconductive surface before that portion of the surface reaches the developer station, de-energizing the developer, and removing the electrical bias on the transfer rolls to prevent transfer of toner thereto and minimize the possibility of carrying excess toner to the cleaning station of the machine. U.S. Pat. No. 4,062,061 teaches the use of a permanent record or log of machine faults stored in memory for display and machine diagnosis. U.S. Pat. No. 4,166,133 discloses a method of recording times between sensors along a paper path as a diagnostic and service aid. U.S. Pat. No. 3,944,794 discloses a system for automatically recovering from a jam or machine malfunction and U.S. Pat. No. 4,338,023 teaches a system for automatically recovering for lost or damaged copy sheets with a minimum amount of operator invention and loss of copy sheets.

The difficulty with the prior art systems is that the copy sheets can often taken multiple paths through the system and the period of control can last as long as 10 seconds in the machine. The system, therefore, must be able to detect and respond correctly to any fault condition. In addition, the control system must be able upon request to change any previously established command, and to control the machine shutdown in accordance with these changes and commands.

It is an object of the present invention, therefore, to provide a new and improved paper path control in the movement of copy sheets throughout multiple paths in a xerographic printing machine. It is another object of the present invention to provide a machine with ease of operator intervention and jam clearance and that automatically minimizes further difficulties during the operator jam clearance. It is another object of the present invention to provide a new and improved controlled shutdown of the paper path system to clear the interfaces between various paper path zones of the machine. It is still another object of the present invention to be able to independently operate the individual zones of the paper path. Further advantages of the present invention will become apparent as the following description proceeds and the features characterizing the invention will be pointed out with particularity in the claims annexed to and forming a part of this specification.

Briefly, the present invention is the controlled shutdown of the pre-registration, fuser, dedicated duplex tray, and machine exit zones of the copy sheet handling system of a machine. In particular, a control data base includes a packet phase describing the origin and destination and all specific details of how each individual copy sheet is to move through the system, a tracker phase showing the current physical location of the sheet in the system, wherein both the lead edge and trail edge of each sheet is tracked and dynamically updated at each control point, and a fault phase showing the specific element that has the fault and which edge of the sheet is the fault, and also showing that a fault has been responded to by the system. At the detection of a malfunction or jam, the control evaluates the status of the sheets in the sheet handling system and makes determinations, for example, to hold sheets from entering into the boundary between the pre-registration, fuser, duplex tray, and machine exit zones, or drives a sheet at the boundary into the next zone.

For a better understanding of the present invention, reference may be had to the accompanying drawings wherein the same reference numerals have been applied to like parts and wherein.

Figure 1:
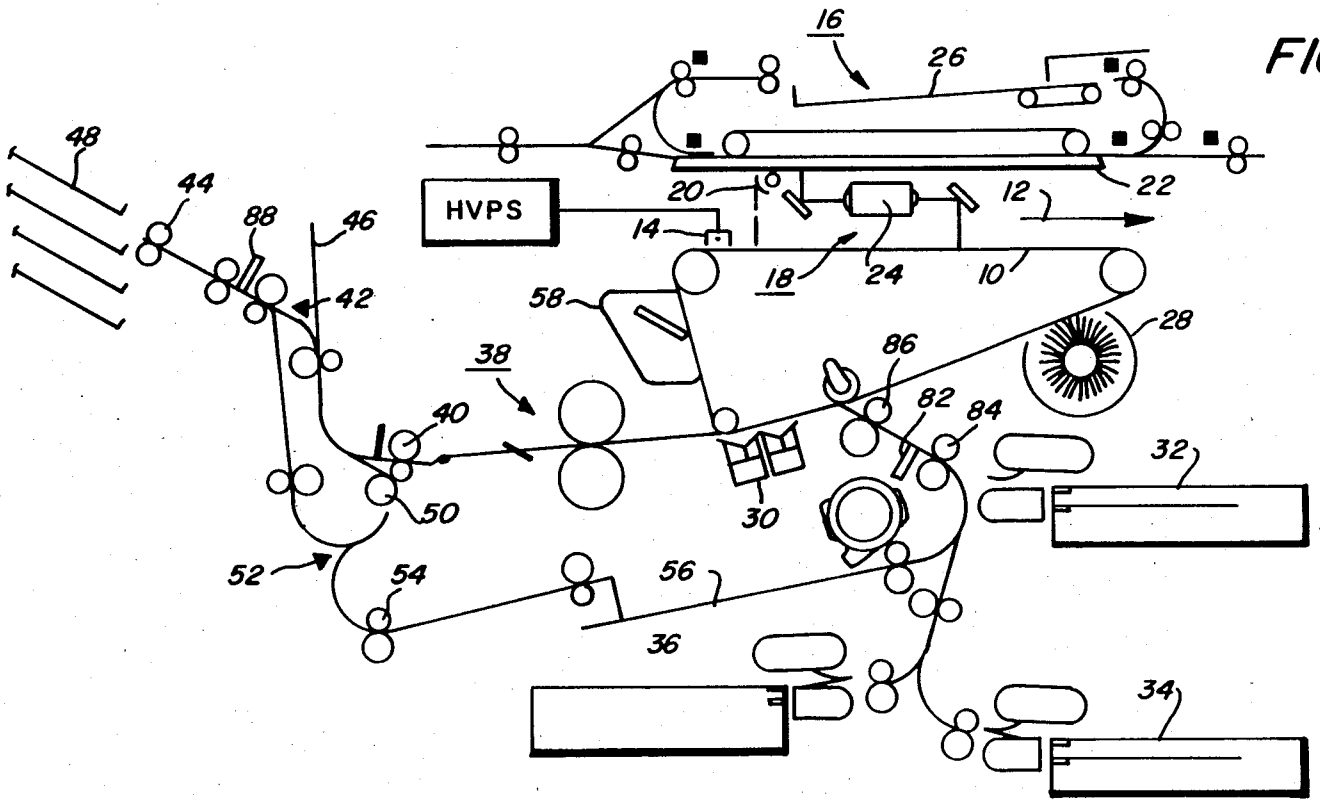
FIG. 1 is an elevational view of a reproduction machine that is controlled in accordance with the present invention.
Figure 2:
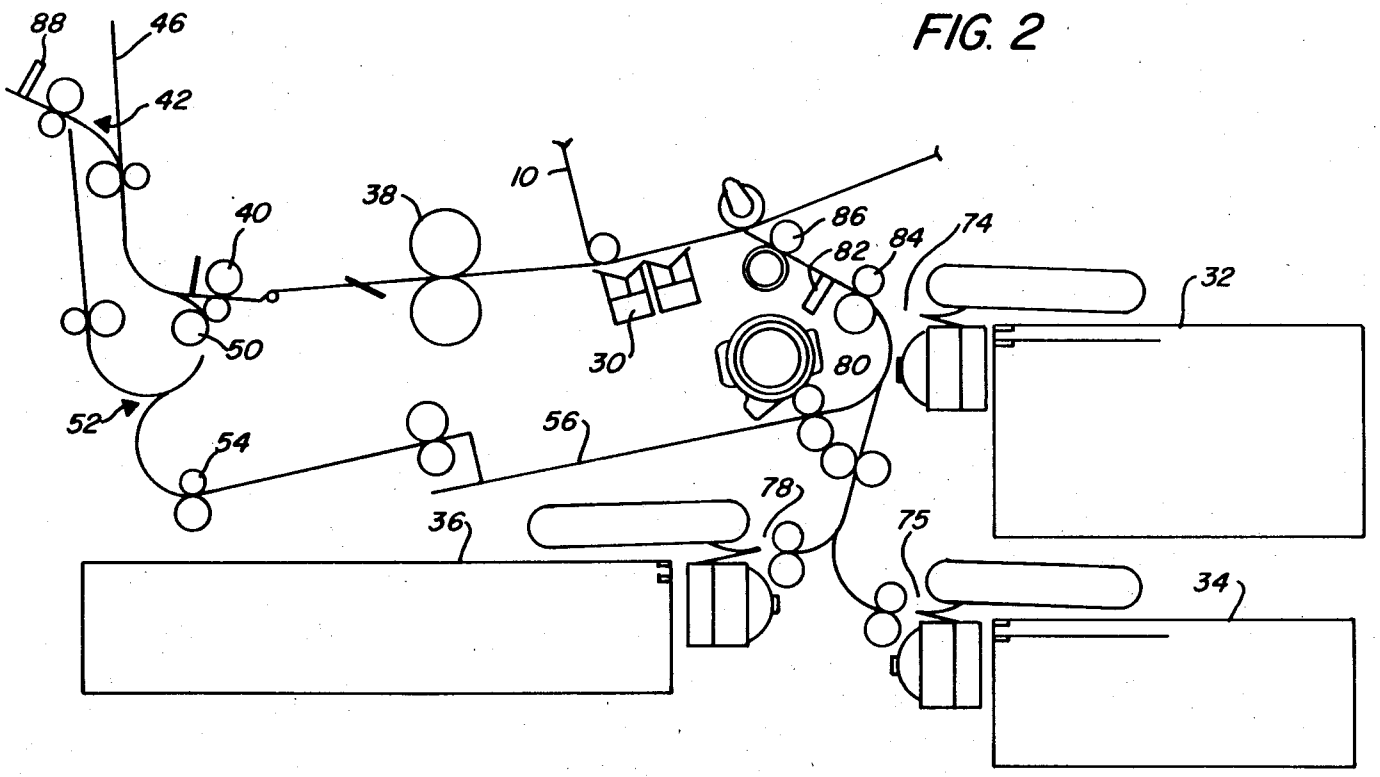
FIG. 2 is an exploded view of the paper path of the machine in FIG. 1.

With reference to FIGS. 1 and 2, there is shown an electrophotographic printing or reproduction machine employing a belt 10 having a photoconductive surface. Belt 10 moves in the direction of arrow 12 to advance successive portions of the photoconductive surface through various processing stations, starting with a charging station including a corona generating device 14. The corona generating device charges the photoconductive surface to a relatively high substantially uniform potential.

The charged portion of the photoconductive surface is then advanced through an imaging station. At the imaging station, a document handling unit 16 positions an original document face down over exposure system 22. The exposure system 22 includes lamp 20 illuminating the document positioned on transparent platen 22. The light rays reflected from the document are transmitted through lens 24. Lens 24 focuses the light image of the original document onto the charged portion of the photoconductive surface of belt 10 to selectively dissipate the charge. This records an electrostatic latent image on the photoconductive surface corresponding to the informational areas contained within the original document.

Document handling unit 16 sequentially feeds documents from a holding tray 26, in seriatim, to platen 22. The document handling unit recirculates documents back to the stack supported on the tray. Thereafter, belt 10 advances the electrostatic latent image recorded on the photoconductive surface to a development station.

At the development station a magnetic brush developer roller 28 advances a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the toner powder image from the photoconductive surface of belt 10 to the sheet.

The copy sheets are fed from a selected one of trays 32, 34 or 36 to the transfer station. After transfer, sheets are advanced to a fusing station. The fusing station includes a fuser assembly for permanently affixing the transferred powder image to the copy sheet. Preferably, fuser assembly 38 includes a heated fuser roller and backup roller with the sheet passing between fuser roller and backup roller.

After fusing, conveyor 40 transports the sheets to gate 42 which functions as an inverter selector. Depending upon the position of gate 42, the copy sheets will either be deflected to output tray 48 over drive rolls 44 or driven up the transport 46. If a sheet is driven onto transport 46, the trailing edge of the sheet upon passing drive rolls 40, drops into engagement with drive rollers. At this point, the sheet will be driven to gate 52. Decision gate 52 deflects the sheet directly into output tray 48 in an inverted mode or deflects the sheets into a duplex inverter roll transport 54 to duplex tray 56. Duplex tray 56 provides intermediate or buffer storage for those sheets which have been printed on one side for printing on the opposite side. In order to complete duplex copying, the previously simplexed sheets in tray 56 are fed in seriatim back to the transfer station for transfer of the toner powder image to the opposed side of the sheet. Invariably after the copy sheet is separated from the photoconductive surface of belt 10, some residual particles remain adhering to belt 10. These residual particles are removed from the photoconductive surface thereof at a cleaning station 58.

Figure 3:
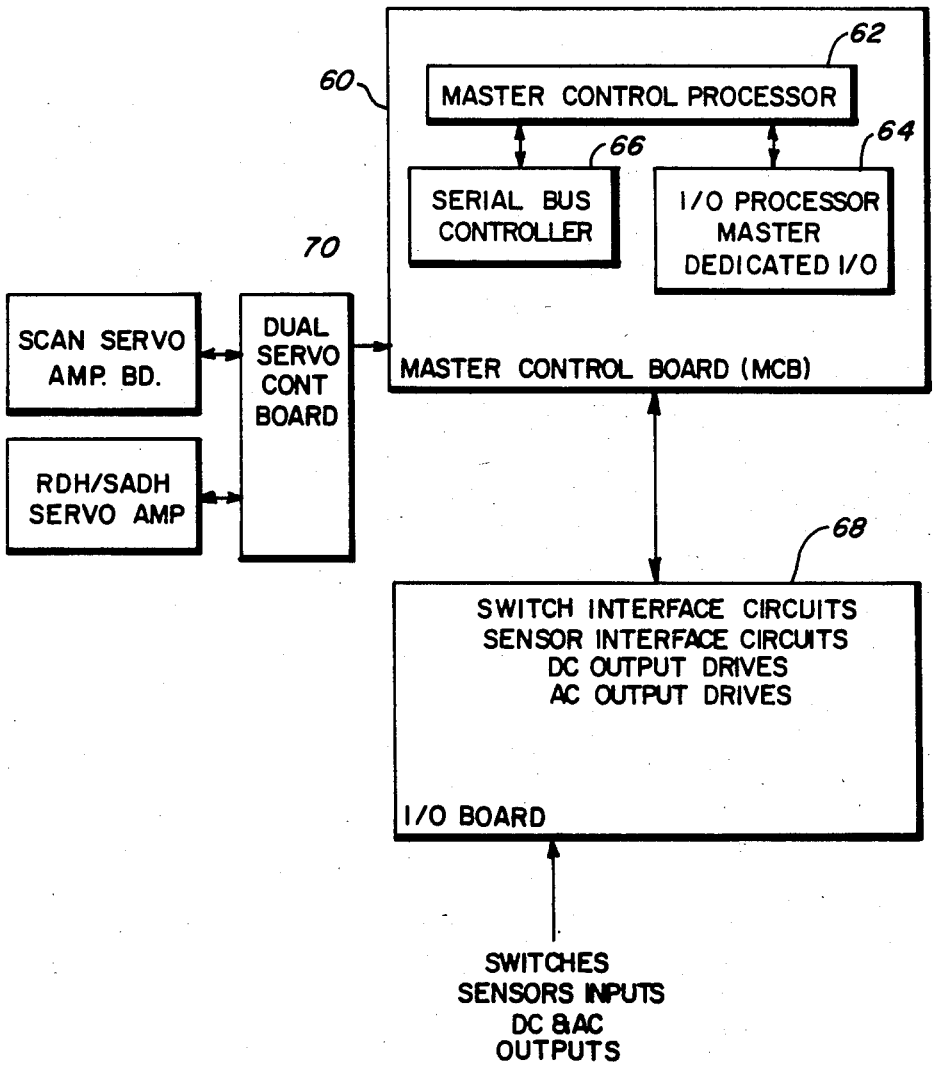
FIG. 3 is a general block diagram of the control for the machine illustrated in FIG. 1.

With reference to FIG. 3, there is illustrated the general control of the xerographic printing machine, in particular a master control board 60, including an Intel 8085 master control processor 62, an Intel 8085 input/output processor 64 and a serial bus controller 66 connected to an input/output board 68 including various switch and sensor interface circuits and DC and AC output drivers. In a preferred embodiment the master control processor includes 80K ROM 8K RAM and 2K MBM memories and suitable timing and reset circuitry. The input/output processor includes 8K ROM, 2K RAM, AD and DA converters and an 8253 timer and 8259 interrupt controller, as well as suitable input and output ports. The master control board 70 is also connected to a dual servo control board over a serial bus for handling scan and document handling servos.

With reference to FIG. 2, there is shown 3 copy sheet trays, 33, 34, and 36 for supplying copy sheets to be driven by drives 74, 76, and 78 to the transfer station at the photoreceptor belt. In a preferred embodiment tray 32 holds 1100 $8\frac{1}{2}\times11$ inch cut sheets, tray 34 holds 600 $8\frac{1}{2}\times11$ inch cut sheets, and tray 36 holds 600 sheets with a variable size of $5\frac{1}{2}\times8\frac{1}{2}$ inch to $11\times17$ inch. Sheets from each of these copy trays are pulled onto the associated drives by associated vacuum feed heads as illustrated. In addition, there is a duplex tray having sheets driven by a bottom vacuum corrugated feeder onto the associated drive rollers 80.

There is a pre-registration switch 82 for sensing the presence of copy sheets at the pre-registration station. The pre-registration drive rolls and each of the drivers associated with a copy sheet trays are driven by a (not shown) servo motor. Registration drive rolls 86 are braked and started via a not shown clutch connected to a servo motor. Following transfer, the sheets are driven to the fuser station 38 and through suitable drive rolls past exit switch 88 to an output tray. The output tray can be sorter bins or a compiler station for finishing. The output tray can be an output catch tray.

For easy jam recovery and clearance of the machine due to a jam or other machine fault, the main paper path compartment is pulled out in the manner of a drawer by the operator. In addition, each of the trays 32, 34, and 36 are also pulled out in a drawer manner for loading the trays. When pulling open these drawers to clear jams or load paper, however, it is important that there be no copy paper extending part way out of the drawer. This will likely cause additional malfunctions or difficulties. In accordance with one aspect of the present invention, therefore, paper that is a potential candidate for extending beyond a drawer boundary is automatically purged out of the boundary during a controlled shutdown of the machines. In order to minimize jam clearance difficulties, therefore, and to assist the operator in purging the machine of copy sheets during a recovery, the control responds to jam situations either to drive sheets forward or to hold back sheets after the sensing of a malfunction. The general mode of operation is to determine based on the conditions, if the paper path shutdown is to be either a cycle down or a hard immediate shutdown.

In a preferred embodiment, there are 3 shutdown areas or zones that are monitored during shutdown; the pre-registration zone, the fuser and the machine exit zone, and duplex tray zone, referred to as the main paper path zone and the machine exit zone. The pre-registration zone is the zone that includes the three copy sheet storage trays and the sheet paths leading to the pre-registration drive rolls 84. In general, upon the detection of a jam or malfunction condition, this zone is monitored. If a copy sheet, for example is being conveyed from one of the copy trays onto the copy sheet path toward the pre-registration drive, the control will force the copy sheet into the pre-registration station to clear the boundary between the copy sheet tray and the pre-registration station. This is done to insure that there are no copy sheets extending from between the copy sheet tray and the pre-registration drive that would inhibit the pulling out of the copy sheet tray or the sheet path module to inspect or correct for copy sheet jams.

The second zone, is the fuser zone and the duplex tray zone. In general, a jam at the fuser, as detected by a fuser exit switch, will force a hard stop at the fuser station, but the system can still drive the sheet registration system to force a copy sheet out of the boundary between the copy sheet feed tray and the registration station. If a jam occurs at the duplex tray, the system continues to drive, for a specified length of time, sheets into the duplex trays or out of the duplex tray.

The final zone is the machine exit zone and covers the machine exit switch 88 either to a sorter or to a compiler tray or non-compiled output tray. In general, upon a jam or malfunction in the machine, the control will drive the sheets at the machine exit zone into the sorter or compiler tray or non-compiled output tray.

In operation, the fuser is cleared if there is not a fuser jam. If there is a fuser jam, there is a hard shutdown at the fuser but for the pre-registration and machine exit zones can still be operated and controlled. If the jam is not in the fuser, the first step in the jam clearance is to clear the fuser. Then if there are sheets entering the duplex tray, these sheets are further driven to avoid any drawer boundaries and finally the machine is cleared to drive the sheets out of the boundaries at the exit station.

In a preferred embodiment, there is itemized in the control memory, a data base for monitoring the tracking the copy sheets. The data base for controlling the sheets in the sheet path consist of a 3 dimensional array. Any controlled element in the system (sheet) is found by a discrete identification number which also allows for easy location of other sheets before and after the current sheet. The ID number is passed from control point to control point in the system, the control point being the various paper sensors.

TABLE 1

| ID | PACKET | | | | TRACKER | | FAULT | |
|---|---|---|---|---|---|---|---|---|
| | | | | | Lead Edge | Trail edge | L.E. Ack F | T.E. Ack F |
| 00 | EOS | INVERT | DESTINATION | SOURCE | | | | |
| | | | | | | | | |
| | | | | | | | | |

With reference to Table 1, the control data base consists of a packet, a tracker and a fault. The packet consisting of the identification number of the copy sheet, describes the origin and destination and all specific details of how each individual sheet is to move through the system. For example, "EOS" represents the end of set designation, "invert" indicates whether or not the sheet is to be inverted, the "destination" identifies whether or not there is to be a duplex mode or not and the "source" of the copy sheet is either one of the three copy sheet trays or the dedicated duplex tray. The tracker portion of the data base shows the current physical location of the sheet in the system. Both lead edge and trail edge of each sheet is tracked and dynamically updated at each of the control points or copy sheet sensors. Finally, the fault portion shows the specific element that has the fault and which edge of the sheet is in fault, either the lead edge or the trail edge. The control has a dynamically updated also shows that a fault has been acknowledged or responded to by the system.

In accordance with the present invention, there are different types of paper path shutdowns depending upon the cause of the malfunction and the status of the machine. Shutdowns range from a hard or a medium stop to various degrees of cycling down with additional movement of the copy sheets, to a mere temporary delay and continuous sheet delivery. Each of the paper path zones can be controlled independently.

The control responds to the type of shutdown by updating the copy sheet data base or data information stored in the copy sheet packet, locates the faulted sheet or sheets and initiates the appropriate shutdown procedure. Once a shutdown is commanded, the control copy sheet data base is searched from the present identification of the copy sheets in progress to find the most recent indication of a fault or malfunction of a copy sheet indicated by either the leading edge or the trailing edge. Based on the most recent fault, the tracker data base determines the present location of the faulted sheet or sheets. Based on the faulted sheet location, one of the various types of shutdowns is scheduled.

The type of shutdown may vary for each of the paper path zones, that is the pre-registration zone, the main paper path zone and the output zone. In the case of a malfunction, an initial check is first made whether or not a shutdown is already in progress. A new shutdown procedure would then be initiated only if it is more severe than the shutdown that is already in progress.

In operation, depending upon the particular type of paper malfunction, each of the zones, the pre-registration zone, the output zone and the main paper path zone, will follow different corrective action.

For example, if there is paper in the fuser, the pre-registration zone will just clear the interfaces to the paper trays. Since there is paper at the fuser, everything at the main paper path will be shut off immediately, and the output station zone will respond by simply waiting for the last sheet to exit the system. That is, all sheets in the output zone will be delivered.

If the paper is in the pre-registration zone, that is, paper in the pre-registration zone is the cause of the malfunction, then the pre-registration zone will crunch the paper to drive it across the boundary and shut down with the paper jam at the pre-registration switch. Again, the output station zone, since the problem is not at the output station zone, will simply deliver all sheets and the main paper zone will deliver all sheets.

If the cause of the malfunction is paper somewhere else in the system, that is not in the pre-registration zone or in the fuser, the shutdown cycle will be as follows. The problem is not at the pre-registration, so the pre-registration zone will simply clear the interfaces to the paper trays. The main paper path system will check for paper in the fuser area. If there is paper in the fuser area, the main paper tray zone will wait for the sheet to exit the fuser area, then clear other interfaces and shut off. Finally, the output zone will simply deliver all sheets. In general, if the shutdown is not due to the paper path, the pre-registration zone, the main paper path zone and the output zone will deliver all sheets. Attached as Appendix A, Appendix B, and Appendix C are the code listings of typical shutdown procedures for the output path, pre-registration, and main paper path areas.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

APPENDIX A (Part 1)

```
/******
DESCRIPTION: This procedure provides all shutdown for output path area

ENTER;   /* GP@CHM@OUTPUT@SHTDN */
        /* SHUTDOWN TYPE IS EITHER
          TYPE1 : IMMEDIATE SHUTDOWN SINCE NO PAPER IN PATH
          TYPE3 : WAIT FOR DRIVES TO FINISH MOVING PAPER
              AND POSSIBLY REMOVING THEM BEFORE
             SHUTTING DOWN. */

  IF LV@CHM@TYPE = TYPE1 THEN
    BEGIN;  /* IMMEDIATE SHUTDOWN */
     FIN¤DRIVE <- 0;
    END;
   ELSE
    BEGIN;
     RACE;
       CASE 3000 MS;
        /* WAIT UNTIL GLB HAS STARTED TURNING OFF THE DRIVES */
       CASE ANYTIME GM@CHM@BASECLR = 1;
        DELAY(UNTIL   EVENT, IoVal(GM@CHM@BASECLR,0));
     END;     /* RACE */
    END;  /* ELSE */
         /* WAIT FOR GLOBAL ROUTINE TO FINISH BASE SHUTDOWN */

  GP@CHM@DBM(LASTACTIVE,GV@CHM@MGR@CUR@PAKT,STAPLED)
    RETURNS LV@CHM@TEMP@PACKET;

  IF (LV@CHM@TYPE ! = TYPE1)  &
    (LV@CHM@TEMP@PACKET ! = "FF")  /* ACTIVE PACKET IS A STAPLE EOS */
```

APPENDIX A (Part 2)

```
  THEN
    WAIT 3000 MS;

 WAIT 1000 MS;
 FIN¤DRIVE <- 0;
    /*SHUTDOWN IS NOW DONE SO TURN OFF EVERYTHING */
 BYP¤GATE,DUP¤GATE <- 0;
 OCT¤DRIVE,STAPL¤ACT,FIN¤EJECT,TRANS¤IN¤DRV,TRANS¤OUT¤DRV <-0;
 FIN¤DVRTR <-0;
    /* ONLY TURN IT OFF IF THIS IS A SORTER,
      OUTPUT IS OVERLAYED WITH RDH OUTPUT*/
 IF (NS@CEX@OUTPUT@CONFIG &  SORTDEVV) THEN
  BEGIN;
   IF (MACH#EX = PAPER) | (SORT#ENT = PAPER) THEN
    BEGIN;
     IF (GV@CHM@SORT@HOME@FLG = 1) THEN
      ;
     ELSE
      BEGIN;
       START GP@CEX@FAULT@STATUS (SORTLEJAM);
```

```
        GV@CHM@SORT@HOME@FLG <- 1;
       END;
     END;
   IF (GV@CHM@SORT@HOME@FLG = 1) THEN
    BEGIN;
     GV@CHM@CURNTBINNO <- GV@CHM@CURNT@BIN@NO;
     GV@CHM@SORTERDIR  <- GV@CHM@SORTER@DIR;
     CANCEL GP@CHM@TRNSVRS@INDX;
     START GP@CHM@TRNSVRS@INDX(0,INIT);
    END;
   START GP@CHM@OUTPUT@SPECIAL(1);
   SORT¤BINUP¤DRV,SORT¤BINDN¤DRV,SORT¤OFSET¤DRIV <- 0;
  END;
    /*SHUTDOWN COMPLETE SO CLEAR PRIORITY*/
 START GP@CEX@MACH@STATUS (BASEHARDWNCOMP);
END ;    /* GP@CHM@OUTPUT@SHTDN */
```

APPENDIX B

DESCRIPTION: This procedure provides all shutdown for pre reg area

```
 IF LV@CHM@TYPE = TYPE1 THEN
  BEGIN;   /*SHUTDOWN WITH PAPER AT PRE REG SWITCH*/
   REG¤CL   <- COAST;
   REG¤BRAK <- BRAKE;
   PREG¤DIR <- FWD;
   PREG¤SPED <- HI;
   PREG¤ENA <- RUN;
   WAIT 700 MS;
  END; /*SHUTDOWN WITH PAPER AT PRE REG SWITCH*/
 ELSE
  BEGIN;   /*SHUTDOWN WITH PAPER NOT AT PRE REG SWITCH*/
   REG¤BRAK <- COAST;
   REG¤CL   <- DRIVE;
   PREG¤DIR <- FWD;
   PREG¤SPED <- LOW;
   PREG¤ENA <- RUN;
   RACE;
    CASE 700 MS;
   ;
    CASE NEXTTIME PRE#REG = NOPAPER;
     REG¤CL <- COAST;
     REG¤BRAK <- BRAKE;
     WAIT 700 MS;     /*AFTER TE TO TRY TO CLEAR
              THE SECOND SHEET FRON AUX*/;
   END; /*RACE CASE*/
  END;  /*SHUTDOWN WITH PAPER
      NOT AT PRE REG SWITCH*/
     /*SHUTDOWN IS NOW DONE SO TURN OFF EVERYTHING */
 PREG¤ENA,REG¤BRAK,REG¤CL,PREG¤DIR <- 0;
 PREG¤SPED <- 1;
 MAN¤AIR,AX1¤AIR,AX2¤AIR,DUP¤AIR <- 0;
     /*SHUTDOWN NOW COMPLETE SO CLEAR PRIORITY*/
```

APPENDIX C

DESCRIPTION: This procedure provides all shutdown for base path area

```
IF LV@CHM@TYPE = TYPE2 THEN
 BEGIN; /*SHUTDOWN WITH PAPER NOT AT FUSER SWITCH*/
      /*LOOK FOR LEAD EDGE TO SEE IF ONE IS COMING
       FROM TRANSFER ZONE*/
  GP@CHM@DBM(CHECKLOCATION,0,XFER@SH /* 33 */)
   RETURNS LV@CHM@PACKET@ID;
  IF (LV@CHM@PACKET@ID ! = "FF") THEN
   BEGIN;/* THERE IS A SHEET IN TRANSFER SO WAIT FOR IT*/
    RACE;
     CASE 2000 MS;
     CASE NEXTTIME FUS#EX = PAPER;
    END;
   END;
  RACE;
  CASE 2000 MS;
  CASE ANYTIME FUS#EX = NOPAPER; /*SHEET GONE*/
  END;      /*RACE CASE WAIT FOR NO PAPER*/
         /*NOW THAT FUSER IS CLEAR WAIT FOR RESTACK TO BE CLEAR*/
  RACE;
  CASE 1400 MS; /*WAIT A WHILE FOR A SHEET TE*/
  CASE ANYTIME DUP#ENT = NOPAPER;
         /*SHEET GONE*/
  END;      /*RACE CASE WAIT FOR NO PAPER*/
 END;   /*SHUTDOWN WITH PAPER NOT AT FUSER EX SWITCH*/

IF LV@CHM@TYPE = TYPE3 THEN
 BEGIN; /*CYCLE DOWN PATH & SET BASE CLEAR FLAG*/
  CYC@DWN LOOP;
   RACE;   /*WAIT FOR NO PAPER*/
    CASE 3000 MS;   /*WAIT A WHILE FOR A SHEET TE*/
     EXIT CYC@DWN;
    CASE NEXTTIME MACH#EX = NOPAPER;
            /*SHEET LEFT MACHINE - COUNTER WILL BE
             UPDATED IN TE@MACH@EXIT */
    CASE NEXTTIME DUP#ENT = NOPAPER;
            /*SHEET MADE IT TO DUP TRAY - COUNTER WILL
             BE UPDATED IN TE@RESTACK */
   END;     /*RACE CASE WAIT FOR NO PAPER*/
   WAIT 50 MS; /*AFTER TE TO BE SURE SHEETS IN PATH IS UPDATED*/
            /*CYCLE DOWN PATH AND SET BASE CLEAR FLAG*/

  RELOOP UNTIL GV@CHM@SHEETS@IN@PATH = 0;
 END;
```

I claim:

1. In a printing machine having a plurality of operating components including a copy sheet path cooperating with one another to produce images on copy sheets, the copy sheet path being divided into a plurality of zones for movement of the copy sheets, each of the zones including an associated copy sheet drive, and a control including a processor and memory, the memory having a plurality of sections, each section maintaining status information relating to the location and travel of the copy sheets in the copy sheet path, including the source and destination of each of the copy sheets within the copy sheet path, the control monitoring the conveyance of copy sheets along the copy sheet path for the occurrence of malfunctions to determine either a cycle down or an immediate shutdown, the method of controlling of the shutdown of the machine upon the detection of a copy sheet malfunction comprising the steps of tracking both the lead edge and the trail edge of each copy sheet and dynamically updating this information in memory for each sheet in the copy sheet path, recognizing the location of the malfunction, determining that a specific copy sheet is the source of the machine malfunction and identifying that either the lead edge or the trail edge of said copy sheet is the source of the malfunction, identifying the zone of location of each of the copy sheets within the copy sheet path, and deciding either a cycle down or an immediate shutdown and responding in accordance with either a cycle down or immediate shutdown.

2. The method of claim 1 wherein the copy sheet zones are a pre-registration zone to pre-register copy sheets at a pre-registration drive roll, a fuser station to sense copy sheets entering and leaving the fuser, and a machine exit station to monitor the copy sheets entering a finishing tray, including the steps of determining that the malfunction is not a copy sheet jam at the fuser, clearing the copy sheet at the fuser station, and clearing the copy sheets at the machine exit switch.

3. In a xerographic printing machine having a plurality of operating components including a photoreceptor and a copy sheet path cooperating with one another to produce images on copy sheets, the copy sheet path being divided into a plurality of zones, and a control including a processor and memory, the memory having a plurality of sections, each section maintaining status information relating to the zone of location and travel of each of the copy sheets in the copy sheet path, the control monitoring the conveyance of copy sheets along the copy sheet path for the occurrence of malfunctions, the method of directing the shutdown of the machine upon the detection of a copy sheet malfunction comprising the steps of recognizing the location of the malfunction, identifying the current zone of location of each of the copy sheets within the copy sheet path, and either retaining each of the copy sheets in the current zone of location or forcing each of the copy sheets into another zone of location.

4. The method of claim 3, including the steps of maintaining the source and destination of each of the copy sheets within the copy sheet path, determining that a specific copy sheet is the source of the machine malfunction, and identifying that either the lead edge or the trail edge of said copy sheet is the source of the malfunction.

5. The method of claim 3 including the steps of tracking both the lead edge and the trail edge of each copy sheet and dynamically updating this information for each sheet in the copy sheet path.

6. In a xerographic printing machine having a plurality of operating components including a photoreceptor and a copy sheet path cooperating with one another to produce images on the copy sheets, the copy sheet path being divided into a plurality of zones including an associated copy sheet drive, and a control including a processor and memory, the memory having a plurality of sections, each section maintaining status information relating to the location and travel of the copy sheets in the copy sheet path, the control monitoring the conveyance of copy sheets along the copy sheet path for the occurrence of malfunctions, the method of controlling of the shutdown of the machine upon the detection of a copy sheet malfunction comprising the steps of recognizing the location of the malfunction, identifying the zone of location of each of the copy sheets within the copy sheet path, determining the presence of any copy sheet extending across the boundary between any of the zones of the copy sheet path, and clearing the copy sheet at the boundary into one of the other of the adjacent zones.

7. The method of claim 6 including the step of determining that a specific copy sheet is the source of the machine malfunction and identifying that either the lead edge or the trail edge of said copy sheet is the source of the malfunction.

8. The method of claim 6, wherein the memory is a random access memory maintaining the source and destination of each of the copy sheets within the copy sheet path.

9. The method of claim 6 including the steps of tracking both the lead edge and the trail edge of each copy sheet and dynamically updating this information for each sheet in the copy sheet path.

10. The method of claim 6, wherein the copy sheet path zones are a pre-registration zone to pre-register copy sheet at a pre-registration drive roll, a fuser station to sense copy sheets entering and leaving the fuser, and a machine exit station to monitor the copy sheets entering a finishing tray, including the steps of determining that the malfunction is not a copy sheet malfunction at the fuser, clearing the copy sheet at the fuser station, and clearing the copy sheets at the machine exit switch.

11. In a printing machine having a plurality of operating components including a copy sheet path cooperating with one another to produce images on the copy sheets, the copy sheet path being divided into a plurality of zones for movement of the copy sheets, each of the zones including an associated copy sheet drive, and a control including a processor and memory, the memory having a plurality of sections, each section maintaining status information relating to the location and travel of the copy sheets in the copy sheet path, the control monitoring the conveyance of copy sheets along the copy sheet path for the occurrence of malfunctions, the method of controlling of the shutdown of the machine upon the detection of a copy sheet malfunction comprising the steps of:

recognizing the location of the malfunction, identifying the zone of location of each of the copy sheets within the copy sheet path, and controlling the machine shutdown in a different manner depending upon the disposition of the copy sheets in each of the zones.

12. The method of claim 11 including the step of immediately stopping the movement of sheets in a first zone while continuing to drive the sheets in a second zone.

13. The method of claim 11 wherein there is a sheet registration zone, a machine finisher zone, and a main copy sheet path zone including the steps of stopping sheets in the main copy sheet path zone while continuing to drive sheets in the pre-registration zone.

* * * * *